United States Patent [19]

Arentzen

[11] Patent Number: 4,457,779

[45] Date of Patent: Jul. 3, 1984

[54] OXIDIZING FLUX FOR SIMULTANEOUS SMELTING/CONVERTING SULFIDES OF HIGH GANGUE CONTENT

[75] Inventor: Charles Arentzen, Tucson, Ariz.

[73] Assignee: Atlantic Richfield Company, Los Angeles, Calif.

[21] Appl. No.: 514,470

[22] Filed: Jul. 18, 1983

[51] Int. Cl.[3] ..... C22B 15/00; C22B 9/10

[52] U.S. Cl. ..... 75/72; 75/257

[58] Field of Search ..... 75/72–76, 75/257

[56] References Cited

U.S. PATENT DOCUMENTS 4,318,737 3/1982 Canning ..... 75/76

*Primary Examiner*—Peter D. Rosenberg

[57] ABSTRACT

A method of producing a metal matte from an unroasted high-gangue content ore which contains iron sulfides by using ferric oxide as a flux to react with the iron sulfides of the ore and provide the oxygen needed to both remove them from the matte and to produce additional ferrous oxide to slag the gangue thus reducing or eliminating the need for a separate converter step.

19 Claims, No Drawings

OXIDIZING FLUX FOR SIMULTANEOUS SMELTING/CONVERTING SULFIDES OF HIGH GANGUE CONTENT

FIELD OF THE INVENTION

This invention is directed toward the improved recovery of metals from unroasted sulfide ores having a high gangue content, and more particularly, to the use of ferric oxide as a flux.

BACKGROUND OF THE INVENTION

A number of metallurgical processes have been developed to treat sulfide-containing metal ores in order to separate the desired metal from the other minerals, and the sand, silt and clay with which they are associated in nature. Typically, the ore is first crushed to a fine size in order to free the sulfide bearing portions from the sand and silt, collectively called the gangue. The crushed ore is next subjected to a flotation operation which removes some of the unwanted gangue and thus concentrates the desired components of the ore. However, there is still more gangue associated with the desired components. Depending upon the specific mineral composition, the sulfide ore concentrate is then treated by a number of pyrometallurgical processes such as roasting, smelting, converting, and refining in order to further separate the sulfides from the gangue, and then recover the desired metals from the cleaner sulfide concentrates during smelting of the sulfide concentrate. During smelting of a sulfide concentrate, the sulfides present form a molten sulfide phase (matte) that is immiscible with the non-sulfide phase (gangue) which forms a slag.

In order for the gangue components to react and make a fluid, "fluxes" are added to the charge. Reaction of the gangue components with a flux causes the gangue to melt at a lower temperature than usual and fuse with the flux to form the fluid mixture referred to as "slag." In addition to its low melting point, the slag is of lower viscosity and lower density than the molten solution of metal sulfides (matte). The slag thus floats on the matte making the separation of the two distinct liquid mixtures easily accomplished, usually by skimming off the supernatant slag.

Roasting of sulfide ores prior to smelting is one method of providing at least a portion of the flux necessary to separate out the gangue substituents. Besides removing excess water and volatile impurities from the ore, roasting in air oxidizes any iron sulfide already present in the ore to ferrous oxide (FeO). During smelting the ferrous oxide acts as a flux and unites with the gangue to form an acceptable slag. However, roasting may also convert some of the other sulfides present to oxides, i.e. sulfides of the desired metal as well as the iron sulfides, whereby that portion of the metal values present in the ore is lost to the slag. U.S. Pat. No. 134,457 and U.S. Pat. No. 1,518,626 are typical of the prior art processes in which a roasting step produces iron oxides from the sulfide of the ore (pyrite) or concentrate prior to smelting.

In the absence of roasting, the flux needed in smelting must be added to the ore charge in order to separate the sulfides from the gangue. If the gangue is essentially silica and alumina, limerock or calcium carbonate ($CaCO_3$) is typically added as the flux. The calcium carbonate acts to remove the gangue into the slag, but leaves all of the iron sulfide to join the matte. Matte produced by smelting varies in grade; the higher grade mattes containing relatively more of the metal sulfide desired and relatively less other metal sulfides, such as iron sulfide. The matte must be further treated to recover the metal by "converting" from the metal sulfide to metal. However, if other unwanted sulfides are present which would also be converted, they must be first removed.

Iron sulfide is a common "contaminant" in copper, nickel and lead ores. Mattes of such ores, when they have less iron sulfide are more desirable and require less energy to convert. For example, copper matte is converted by a bessemerizing process in which the matte is blown with air and a siliceous flux material is added. The air first oxidizes any iron sulfides in the matte to form ferrous oxide. The resulting ferrous oxide slags with the silica flux added and is removed in the form of an iron and silica compound, called fayalite ($Fe_2SiO_4$). This slag may be recycled to the smelter for retreatment and further removal of any copper still present in the slag.

Only after the remaining iron sulfide has been oxidized, will further blowing oxidize the sulfur present in the copper sulfide to sulfur dioxide, leaving metallic copper known as blister copper. This product, when solidified is porous, brittle and is about 98% copper. Blister copper can be further treated by pyrometallurgical methods and by electrolysis to improve its physical properties and to remove the remaining impurities. U.S. Pat. No. 3,081,163, U.S. Pat. No. 865,333, and U.S. Pat. No. 812,785 are representative of the prior art processes related to this converting process and the processing of the slag therein. U.S. Pat. No. 813,825 teaches that silica may be fluxed with iron (ferrous) oxide. However, as in the case of U.S. Pat. Nos. 812,785 and 813,824, the iron (ferrous) oxides are produced by adding compressed air to effect oxidation of pyrites ($FeS_2$) within the charge to the smelting unit.

Some sulfide ores, even after concentration, contain a high proportion of gangue relative to sulfide content. Energy expenditures for roasting such ore exceeds the benefit to be gained from the small amount of FeO useful as flux that would result. With the absence of roasting, a relatively large amount of flux must normally be added to such an ore to separate out the gangue components, and the addition of additional flux creates more waste materials with their associated pollution and disposal problems.

In addition, the grade of the resulting matte is low due to residual sulfides requiring additional treatment, additional fluxing materials and additional energy expenditure to yield an acceptable metal product.

Therefore, although the extraction of metal from this type of ore has been possible it has not been profitable. A process, such as that of the instant invention, for treating ores with a high gangue content which reduces some of the energy consumption involved in recovering the metal, and also reduces the amount of additives needed while allowing the recovery of a better product is a clear advance in the state of the art.

SUMMARY OF THE INVENTION

According to the present invention, a flux comprising ferric oxide totally or partially replaces the $CaCO_3$ flux normally added to a smelting furnace with the ore, the ore concentrate, or other charge containing iron sulfides in addition to, or as part of other sulfides. The chemical reactions which occur in the furnace are mostly between the various materials present in the charge. The furnace is of a type wherein virtually no oxidation of the ferruginous, i.e. iron-containing, sulfides in the ore would occur in the absence of an oxidizing flux. In lieu of roasting, the ferric oxide flux of the present invention preferentially reacts with the iron containing sulfides present in the charge to form many more molecules of ferrous oxide than would otherwise be available to function as a flux for the gangue constituents present in the charge. Thus, the iron from both the iron sulfides in the charge and the iron (ferric) oxide added as a flux ultimately become available to react with the gangue. The fayalite slag produced in such a case has a lower melting point and lower viscosity than that formed by the $CaCO_3$ flux and is more easily separated. With much of the iron sulfide originally present in the charge removed, the resulting matte contains less iron sulfide, i.e. the grade of the matte is raised, and the need for the additional converter step is reduced or eliminated.

Typical chemical reactions of the above smelting process are as follows:

$$5\ Fe_2O_3+FeS_2 \rightarrow 11\ FeO+2SO_2 \quad \text{(i)}$$

$$3\ Fe_2O_3+FeS \rightarrow 7\ FeO+SO_2 \quad \text{(ii)}$$

$$5\ Fe_3O_4+FeS_2 \rightarrow 16\ FeO+2SO_2 \quad \text{(iii)}$$

$$3\ Fe_3O_4+FeS \rightarrow 10\ FeO+SO_2 \quad \text{(iv)}$$

$$2\ FeO+SiO_2 \rightarrow Fe_2SiO_4\ \text{(fayalite slag)} \quad \text{(v)}$$

The equations (i)-(iv) depict reduction of ferric oxides to form many additional molecules of ferrous oxide useful as a flux material while oxidizing and removing the sulfides present. In equation (v) the ferrous oxide formed in the reactions depicted in equations (i)-(iv) fluxes the silica present in the charge to form $2FeO.SiO_2$, i.e. $Fe_2SiO_4$, fayalite slag.

The invention solves many problems of the prior art and results in a number of advantages for smelters. Because less flux is required, the cost of materials and transportation is reduced. Energy requirements are reduced since a lower melting point and lower viscosity slag is formed and the converter step which would normally consume additional energy can be reduced or eliminated.

DETAILED DESCRIPTION OF THE INVENTION

The present invention provides a process for smelting sulfide containing ores wherein the limestone ($CaCO_3$) normally used as a flux for unroasted sulfide ores or their concentrates, is totally or partially replaced with ferric oxide. The result is a number of improvements in the known smelting and conversion processes utilized to recover the metals from sulfide containing materials, especially those ores having a high gangue content.

It is anticipated that the present invention will be most useful in the recovery of copper from its sulfide ores, however as will be apparent to those skilled in the art, the concept of the present invention can be adapted for use in recovery of nickel, lead, cobalt and precious metals from their ores.

The invention may be beneficially used with a wide variety of sulfide ores which contain a combination of gangue and iron sulfide containing minerals. This interrelationship of gangue with iron sulfides is a requirement or prerequisite for optimum benefits of the invention. In other words, the invention is not applicable to an ore with no iron sulfide containing-minerals present.

Examples of some iron sulfide containing minerals are:

Pyrrhotite—$FeS$
Pyrite—$FeS_2$
Chalcopyrite—$CuFeS_2$
Borite—$Cu_5FeS_4$

Similarly, the invention does not apply to an ore with no gangue. Preferably, the ore contains at least about 1% gangue. For each one percent of gangue about 0.25 to about 1.0 percent pyrite or about 0.3 to about 0.4 percent pyrrhotite or equivalent combination is desired in the sulfide material. Other iron sulfide minerals such as chalcopyrite will further modify the above ratios, requiring from about 0.47 to about 3 percent for each one percent of gangue. The composition of the gangue, typically consists primarily of silica.

When an ore concentrate comprises the ore charge a ratio of from about 5% to about 10% gangue and about 2% to about 10% ferruginous sulfide is desirable.

The ferric oxide flux added according to the process of the present invention is preferably ferric oxide, primarily in the form of hematite, $Fe_2O_3$, but magnetite, $Fe_3O_4$ (a combination of ferric and ferrous oxides, $Fe_2O_3.FeO$) may also be present in varying amounts in the ferric oxide charge. In general the iron oxide useful in the present invention has the following formula $Fe_xO_y$ wherein x is less than y, i.e. Fe has a valence state greater than $2^+$. Both $Fe_2O_3$ and $Fe_3O_4$ will react with the iron sulfide present to form ferrous oxide (FeO) and sulfur dioxide according to the following equations:

$$3Fe_2O_3+FeS \rightarrow 7FeO+SO_2 \quad \text{(ii)}$$

$$3Fe_3O_4+FeS \rightarrow 10FeO+SO_2 \quad \text{(iv)}$$

The FeO then fluxes the gangue to produce slag according to the general formula:

$$2FeO+SiO_2 \rightarrow 2FeO.SiO_2\ \text{or}\ Fe_2SiO_4\ \text{(fayalite)} \quad \text{(v)}$$

As will be readily apparent to those skilled in the art, the exact amount of iron oxide utilized in the charge will depend upon the composition of the specific ores or ore concentrates utilized. However, an approximate ratio of 25 parts of $Fe_xO_y$ to 8 parts of pyrite to 10 parts of gangue is operational, and the exact amounts are adjusted to maximize the benefits of the reaction.

The smelting of the ore takes place in a reaction chamber in which the chemical reactions occur mostly between the various materials which make up the charge, i.e. substantially no oxidation of the sulfides present in the ore would occur in the absence of the oxidizing flux. Typically, a reverberatory furnace would be used to accomplish the smelting, however an electric furnace or any reaction chamber which meets the criteria described may be utilized. The charge is heated to a temperature of from approximately 1150° C. to approximately 1300° C.; the specific temperature depending upon the exact composition of the materials which make up the charge. When the appropriate temperature is reached, the slag begins to form a supernatent layer floating atop the more dense sulfide matte, and the entire mixture is held at that temperature for approximately 15 minutes to approximately 120 minutes, to allow the various reactions to reach completion. The conventional procedures for withdrawing slag, and recovering the matte can then be followed, with the matte being tested to assess its content of impurities and any need for further treatment.

The invention has application to special processes such as continuous smelting processes which may use the addition of the $Fe_xO_y$ flux in a somewhat different manner. For example, in INCO flash smelting the matte grade produced is specific for a given charge. In order to change the matte grade, special techniques such as partial roasting, water injection, recycle of inerts, etc. are used. Ferric oxide addition can also be used to accomplish the same effect. Similarly, in the Kivcet and KHD processes, ferric oxide ($Fe_xO_y$) as a "tempering agent" can be used to modify temperatures and melt products.

Although the invention has now been described with reference to preferred embodiments, it will readily be appreciated by those of ordinary skill in the art that many further modifications and adaptations of the invention are possible without departure from the spirit and scope of the invention which is limited only by the appended claims.

What is claimed is:

1. A method of producing a metal matte from a charge of a ferruginous sulfide-and gangue-containing metal ore not previously roasted, comprising heating said charge in the presence of an oxidizing flux comprising ferric oxide having the formula, $Fe_xO_y$, wherein x is less than y, in a reaction chamber in which substantially no oxidation of said sulfide takes place in the absence of an oxidizing flux.

2. The method of claim 1 wherein the gangue of said ferruginous sulfide and gangue-containing metal ore comprises at least 1% of said ore.

3. The method of claim 1 wherein said ore comprises ferruginous sulfide in an amount of from about 0.25 percent to about 3 percent for each one percent of gangue.

4. The method of claim 1 wherein the oxidizing flux is a mixture of ferrous and ferric oxides.

5. The method of claim 1 wherein said oxidizing flux further comprises limestone.

6. The method of claim 1 wherein said ore charge comprises an approximate ratio of 8 parts pyrite to 10 parts gangue to approximately 25 parts of $Fe_xO_y$ present as flux.

7. The method of claim 1 wherein said ore comprises ore concentrate.

8. The method of claim 7 wherein said ore concentrate comprises from about 5% to about 10% gangue and from 2% to about 10% ferruginous sulfide.

9. The method of claim 1 wherein said charge and flux are heated to a temperature of from about 1150° C. to about 1300° C.

10. The method of claim 9 wherein said temperature is maintained from about 15 minutes to about 120 minutes.

11. The method of claim 1 wherein said reaction chamber is a reverbatory furnace.

12. The method of claim 1 wherein said reaction chamber is an electric furnace.

13. The method of claim 1 wherein said metal matte is further converted to the elemental metal.

14. The method of claim 1 wherein said metal ore charge contains copper and said metal matte produced is a copper matte.

15. The method of claim 14 wherein said copper matte is further converted to blister copper.

16. In a process for producing a metal matte from an unroasted metal ore having a ferruginous sulfide and gangue content, the improvement comprising reacting said ore in the presence of an oxidizing flux comprising ferric oxide having the formula $Fe_xO_y$, wherein x is less than y, in a reaction chamber in which substantially no oxidation of said sulfide takes place in the absence of an oxidizing flux.

17. The process of claim 16 conducted at a temperature sufficient to react the ore and flux for a time sufficient to form a slag layer and a matte layer.

18. The process of claim 16 wherein the metal ore contains copper and the metal matte produced is a copper matte.

19. The process of claim 18 wherein said copper matte is further converted to elemental copper.

* * * * *